United States Patent [19]

Valditerra

[11] Patent Number: 4,867,068

[45] Date of Patent: Sep. 19, 1989

[54] RAILWAY TRAIN SET FOR THE RENEWAL OF RAILWAY TRACKS

[75] Inventor: Enrico Valditerra, Novi Ligure, Italy

[73] Assignee: Valditerra S.p.A., Novi Ligure, Italy

[21] Appl. No.: 748,612

[22] Filed: Jun. 25, 1985

[30] Foreign Application Priority Data

Jul. 10, 1984 [IT] Italy ..... 67700 A/84

[51] Int. Cl.[4] ..... E01B 29/05

[52] U.S. Cl. ..... 104/2; 104/6; 221/210; 414/331; 414/339; 414/501

[58] Field of Search ..... 104/2, 4, 5, 6; 414/331, 339, 501; 221/79, 88, 210

[56] References Cited

U.S. PATENT DOCUMENTS

| | | | |
|---|---|---|---|
| 3,473,482 | 10/1969 | Pouget | 104/6 |
| 3,638,577 | 2/1972 | Plasser et al. | 104/6 |
| 4,211,170 | 7/1980 | Theurer | 104/2 |
| 4,253,398 | 3/1981 | Theurer et al. | 104/2 |
| 4,266,615 | 5/1981 | Theurer et al. | 104/2 X |
| 4,325,306 | 4/1982 | Valditerra | 104/2 |
| 4,428,296 | 1/1984 | Scheuchzer et al. | 104/2 |
| 4,542,697 | 9/1985 | Cicin-Sain | 104/2 |

*Primary Examiner*—Johnny D. Cherry
*Assistant Examiner*—Dean J. Kramer
*Attorney, Agent, or Firm*—Young & Thompson

[57] ABSTRACT

A railway train set intended to be used for the renewal of railroads, which comprises an operative assembly with two mutually coupled vehicles, the first of which is provided with two axles or bogies and the second is articulated at one of its own ends to a point of the first vehicle, situated in a position cantilevered with respect to its axles, and is provided at its opposite end with a single axle or bogie; the first vehicle includes a device situated between the two axles for removing the old rails, a device for allowing the second axle to advance on the old sleepers deprived of the rails, and a device for handling the old and the new equipment; the second vehicle includes a device for the removal of the old sleepers, a device for levelling or displacing or scarifying the ballast and a device for laying the new sleepers, as well as structure for allowing the second vehicle to advance on the new sleepers not yet provided with the new rails; and in the region of the articulation between the two vehicles there is disposed a device for correcting, according to the necessities, the position of the second vehicle and hence the position for laying the new sleepers. There are further provided particular structure for laying the new sleepers and a store for special sleepers.

4 Claims, 2 Drawing Sheets

RAILWAY TRAIN SET FOR THE RENEWAL OF RAILWAY TRACKS

BACKGROUND OF THE INVENTION

This invention relates to a railway train set intended to be used for the renewal or the laying of railway tracks.

Several types of railway vehicles or train sets are known which can be displaced (by their own means or attached behind other train sets) on the railway tracks for being transferred from a depot to a working zone where, after having reached it, they carry out by mechanized means the operations of removing the rails to be substituted, removing the old sleepers, levelling and displacing or scarifying the ballast, laying the new sleepers and finally laying the new rails in lieu of the previous ones, the laying of the new sleepers and rails being feasible exactly on the place in which the former ones were lying, in order to maintain the preceding path, or else in positions somewhat modified with respect to the preceding ones, in order to compensate for the displacements which have taken place and thus restore the original path, or to make corrections to the preceding path. These known vehicles and train sets are too heavy, too bulky, complicated and expensive and they give rise to considerable problems for their optimal utilization.

SUMMARY OF THE INVENTION

The object of this invention is to improve the known railway train sets intended to the above described purpose, so as to considerably reduce the weight, the encumbrance and the cost thereof and to render more easy and rational their utilization as regards both the operations of renewing the deteriorated equipment still respecting the preceding path and the introduction of possible corrections to the railroad path.

The train set according to this invention is mainly characterized: in that it comprises an operative assembly formed by two mutually coupled vehicles, the first vehicle being provided with two axles (or bogies) while the second is articulated at one of its own ends to a point of the first vehicle, situated in a position cantilevered with respect to the axles, and is provided with a single axle (or bogie) situated at the end opposite said articulation; in that the first vehicle is provided with means, situated between the two axles, for removing the old rails, means for allowing the second axle to advance on the old sleepers already deprived of the rails, and means for handling the old and the new equipment; in that the second vehicle is provided with means for removing the old sleepers, means for levelling or displacing or scarifying the ballast and means for laying the new sleepers, as well as means for allowing the second vehicle to advance on the new sleepers not yet provided with the new rails; and in that in the region of the articulation between the two vehicles there are disposed means for correcting, according to the necessities, the position of the second vehicle and hence the position for laying the new sleepers.

Thanks to these characteristics the first vehicle of the operative assembly of the train set according to the invention (preceded, as usual, by stocking cars which carry the new equipment to be laid and are intended to receive the old equipment which has been removed) runs with its first axle on the track which has to be renewed, previously deprived of the attachment members, carries out the removal of the old rails, and advances with its second axle on the old sleepers still lying on the track, thus following exatly the pre-existing path. The second vehicle of the operative assembly, on its turn, since it is articulated at a point of the first vehicle which is situated in a position cantilevered with respect to the axles, spontaneously tends to assume a position in which its longitudinal axis is tangent to the pre-existing path, when this latter differs from a rectilinear path, so that the laying of the new sleepers spontaneously tends to take place in conformity with the previous path, thus reducing to a minimum the necessities of corrections, which may be made manually or automatically, by the use of the special means provided in the region of the articulation, either to maintain with the maximum precision the old path or to make thereon the desired modifications.

The invention also specifically relates to means for laying the new sleepers, means for correcting, according to the necessity, the position of the second vehicle, and a particular store for special sleepers.

BRIEF DESCRIPTION OF THE DRAWINGS

These and other particularities and the advantages of the invention will be apparent from the following description of an embodiment, given by way of a non-limiting example and diagrammatically shown in the annexed drawings, in which.

DETAILED DESCRIPTION OF THE PREFERRED EMBODIMENTS

Figure 1:
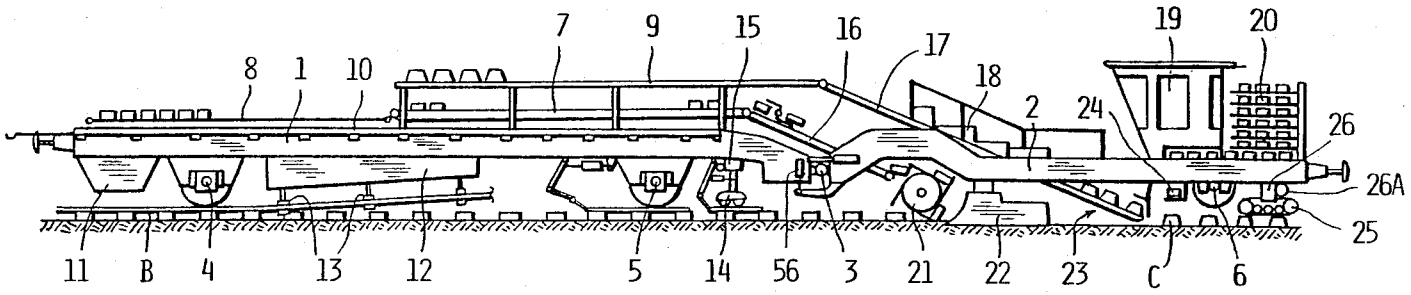
FIG. 1 is a side view on a small scale of the operative assembly formed by two vehicles, according to the invention.

A railway train set for the renewal of railway tracks, according to the invention, generally comprises an operative assembly as shown in FIG. 1 (arranged to advance from the right-hand to the left-hand side according to the drawing), further operative means, per se known, mounted on cars, not shown, which follow the operative assembly, and a certain number of stocking cars intended to carry the new equipment which has to be laid and to receive the removed old equipment, said cars being disposed to precede (in the advancement direction of the train set) the operative assembly of FIG. 1.

The operative assembly of FIG. 1 comprises two vehicles defined by their frames 1 and 2, which are spherically articulated to one another at 3. The frame of the forward vehicle has a first axle 4 and a second axle 5 (which however could be substituted by corresponding bogies), while the frame of the second vehicle rests at front, through the articulation 3, on the frame 1 and at rear on its own axle 6 (which could as well be substituted by a bogie). The articulation point 3 is situated in a position cantilevered with respect to the axles 4 and 5 of the first vehicle.

Figure 2:
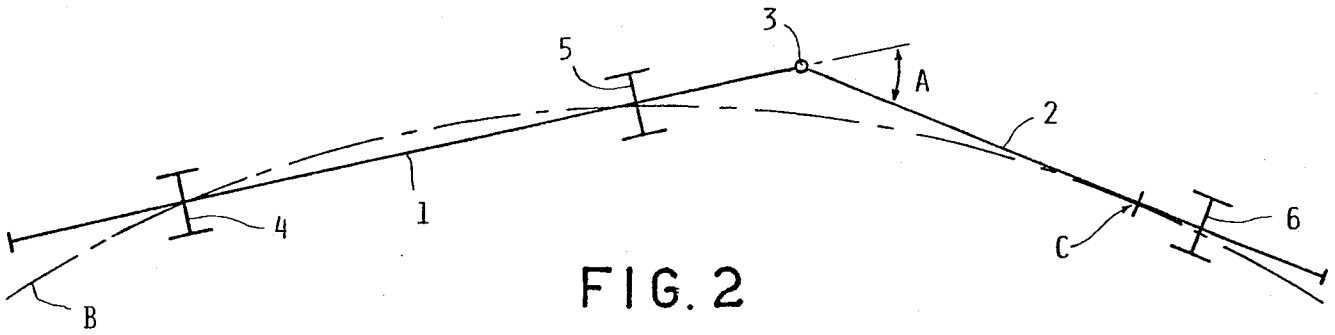
FIG. 2 is a plan view showing a diagram of the disposition which the operative assembly shown in FIG. 1 assumes on a curved track.

In FIG. 2 are diagrammatically shown, by means of their axes, the trajectory of the line along which is or should be disposed the railroad B, and the first and second vehicle mutually articulated at 3. At it can be seen when observing this figure, when the axis of the railroad B forms a curve, the axis of the first vehicle (which rests on the axles 4 and 5) intersects the axis of the railroad B at the said axles, and accordingly the articulation point 3, which is cantilevered, is displaced towards the outside of the curve. Thus, the second vehicle, which follows the first vehicle, tends to assume a position in which its axis is approximately tangent to the curved axis of the railroad B. A suitable choice of the position of the articulation 3 relative to the positions of the axles 4, 5 and 6 ensures that, on a curved track, the axis of the second vehicle will be tangent to the curved axis of the railroad B, with a good approximation, in register with the laying point C of the new sleepers, which condition is the most favorable, as it will be seen later on.

The frame 1 of the first vehicle supports, on the upper portion, a conveyor 7 which leads to a store 8 for the removed old sleepers, a store 9 for the new sleepers to be laid, and a service track 10 for a conveyor (known per se and not shown) intended to handle the equipment between the stores 8 and 9 and the stocking cars which precede the operative assembly 1–2. Furthermore, the frame 1 carries, in its lower portion, a motor set 11, generally a Diesel engine which actuates a hydrydynamic power station and an electric generator for feeding the various operating members of the assembly, a frame 12 provided with roller tongs 13 disposed (in a manner per se known) for lifting and moving away from the underlying sleepers the old rails which have to be removed, and an auxiliary bogie 14 (liftable by means of a hydraulic cylinder 15) which pertains to the means intended to allow the second axle 5 to advance on the old sleepers already deprived of the rails.

Figure 3:
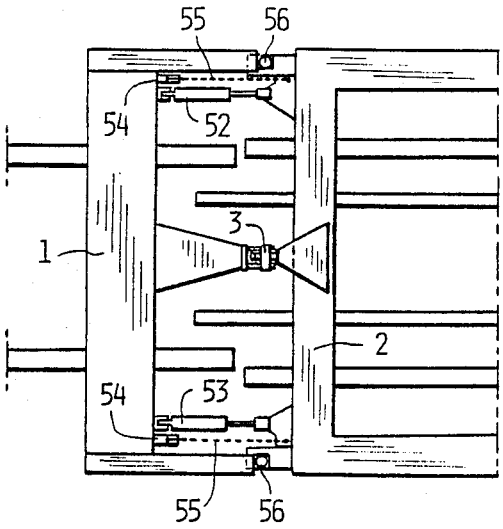
FIG. 3 is a plan view showing the means for correcting the position of the second vehicle relative to the first.

The means for correcting the position of the second vehicle, which will be described in more detail later on with reference to FIG. 3, are installed in a position corresponding to the articulation 3 between the frames 1 and 2.

The frame 2 of the second vehicle carries, on its upper portion, a conveyor 16 which leads to the conveyor 7 of the first vehicle, for the removed old sleepers, a conveyor 17 connected to the store 9 of the first vehicle, for the new sleepers to be laid, a railing-step board 18 for the surveillance of the laying operations and for possible actions on the respective mechanisms, an operator's cabin 19 and a store 20 (described in more detail later on with reference to FIGS. 5 and 6) for special sleepers to be laid in particular locations, such as for example at the level-crossings. On the lower portion the frame 2 carries a device 21 for the removal of the old sleepers, which feeds the conveyor 16, a share 22 for levelling or removing the ballast, the unit 23 for laying the new sleepers (which will be described more in detail later on with reference to FIG. 4), a distributor 24 for the special sleepers coming from the store 20, and a crawler support 25 which can be lifted, for example by means of a hydraulic cylinder 26. This latter assembly, which is lifted for the approaching movement on tracks, when the axle 6 is operating, is lowered (to the position shown in the drawings) during the work, and allows the second vehicle to proceed by resting on the just laid new sleepers, which are still without rails (or, according to a possible alternative, sideways of said sleepers). A hydraulic cylinder 26A may be provided for fixing the orientation of the crawler support 25 while it is acting.

The operative assembly described hereinabove acts by proceeding in a continuous manner towards the left in FIG. 1, running by means of the axle 4 on the old rails deprived of the bolts, lifting and moving away the old rails by the action of the means 12—13 while the old sleepers remain laid on the ballast, sliding on these old sleepers by means of the axle 5 and the auxiliary bogie 14, removing by means of the removal device 21 the old sleepers which the conveyors 16 and 7 carry to the store 8, levelling or displacing or scarifying the ballast by means of the share 22 and the associated operative means, and laying at the location C the new sleepers, on which the assembly advances by means of the crawler support 25. The further operations (laying the new rails, compacting the ballast and so on) are then carried out by subsequent operating means, which do not form a subject-matter of the present invention and are not described nor illustrated herein.

The fact that the second vehicle is articulated to the first vehicle in the manner already described hereinabove, thanks to which the location C of laying the new sleepers is disposed, with a good approximation, on the curve locally formed by the railroad, causes the laying of the sleepers to take place spontaneously in a manner very near to the optimal one. Only slight corrections may be required, especially in case of anomalies of the path, or when for any reason whatever it is desirable that the preceding path of the track be modified.

In order to allow these corrections, as shown in FIG. 3, in the region of the articulation 3 between the frames 1 and 2 of the vehicles forming the operative assembly there are installed two horizontal hydraulic cylinders 52, 53, which allow to modify the angle A (FIG. 2) formed between the axis of the frame 2 of the second vehicle and the axis of the frame 1 of the first vehicle, thus modifying in conformity with the requirements the position, transversely to the railroad, of the point C of laying the new sleepers. To allow an exact calculation of the required corrections, the angle A formed between the two frames 1 and 2 may be exactly determined by detection elements 54, for example potentiometers, installed on one frame and connected to the other frame by flexible tie rods 55. The calculation of the corrections and the actuation of the cylinders 52 and 53 may be carried out manually or by duly programmed automatic means, on the basis of the knowledge of said angle A and the local geometric parameters of the line.

Preferably, in the region of the articulation 3 there are also disposed, on both sides of the vehicles, two vertical cylinders 56 which allow to lock and to correct the transverse inclination of the corresponding leading end of the frame 2. It should be understood that all these correction devices, indicated as being formed by hydraulic cylinders, may also be provided in the form of mechanical or electromechanical devices. Moreover, besides the described possibilities of correction, the various operating devices 21 to 24 installed on frame 2 may be suitably provided with means for the individual adjustment of the operative position of said devices.

For the operation of laying the new sleepers it is usual to employ a chute or band which reaches a location situated near the ballast and on which the sleepers descend one after the other under the control of an obturator which allows them to proceed one at a time at suitable moments; the laying on the ballast takes place by falling from the lower end of the chute or band. This arrangement has the disadvantage that when a sleeper is on the point to leave the chute or band, the entire load of its weight concentrates on its lower rear edge, which therefore often results in being damaged, especially in case of concrete sleepers. In addition, the variability of the distance between the end of the chute and the ballast, and other accidental conditions, may lead to some irregularity in laying the sleepers in accordance with this process.

Figure 4:
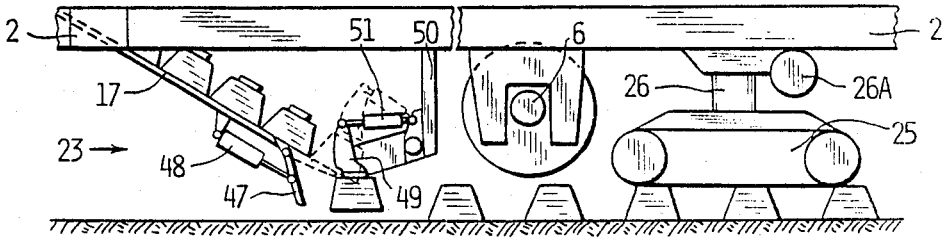
FIG. 4 shows the means for laying the new sleepers.

According to the invention, these disadvantages are avoided by means of a trap device 23 diagrammatically shown in FIG. 4. The chute or band 17, along which descend the sleepers to be laid, terminates with a trap 47 which may be lowered by means of a hydraulic cylinder 48, while, facing the trap 47, a grasping device 49 is pivoted on a support 50 fixed to the frame 2 of the second vehicle of the operative assembly, and may be operated by means of a hydraulic cylinder 51. The grasping of the sleepers by the device 49 may be carried out by means of tongs or by means of an electromagnet acting in the region of the metal plates supporting the rails, which plates are previously applied onto the sleepers. The grasping device 49, lifted to the position shown by broken lines, receives every time a sleeper which is grasped while resting on the trap 47, and thereafter the trap 47 is lowered and the device 49 allows to position the sleeper onto the ballast by adjusting its position with the desired precision. During this operation, no concentration of stresses is applied on any portion of the sleeper, which therefore is laid in a completely undeteriorated condition.

Figure 5:
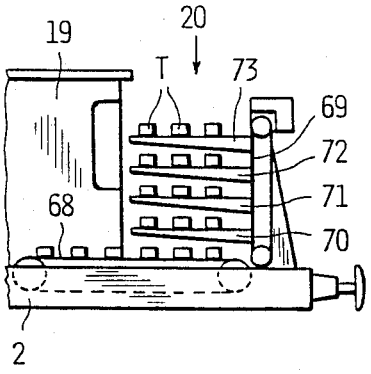
FIG. 5 shows in particular a store for special sleepers.
Figure 6:
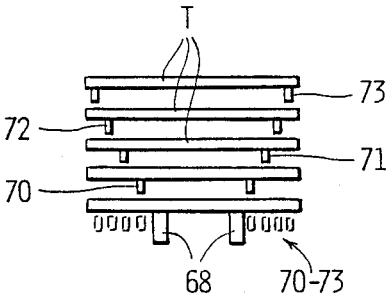
FIG. 6 shows a cross-section of FIG. 5.

The function of store 20 installed in the operative assembly is to render available special sleepers T intended to be used in particular regions of the line, for example at level-crossings. These sleepers may be laid, at the location C, by means of a special laying device 24. As shown in FIG. 5, the store 20 comprises a horizontal conveyor 68 arranged to transfer the special sleepers from the store 20 to the laying device 24, and a vertical conveyor 69 provided with a plurality of pairs of horizontal brackets 70, 71, 72, and so on, superposed at uniform steps and carrying superposed ranks of special sleepers T. When all the sleepers disposed on the horizontal conveyor 68 have been shifted outside the store 20, the vertical conveyor 69 may be lowered by a step, thus positioning onto the horizontal conveyor 68 the sleepers T carried by the lowermost pair of brackets 70. For rendering possible this operation, each pair of brackets has a gauge which is different from that of the other pairs of brackets and from that of the horizontal conveyor 68; for example, as shown in FIG. 6, the gauge may increase from the lower to the upper part. In this way, the pairs of brackets 70, 71 and so on, as they arrive beneath the level of the horizontal conveyor 68, accumulate at the sides of this latter at the level of frame 2, in the positions shown by broken lines. Thanks to this arrangement a compact store is formed, which is a small space contains a considerable number of sleepers T and may be loaded and unloaded by simple and quick operations.

It is to be understood that the train set according to this invention may have all the characteristics described herein or also only a part of them, according to the particular applications to which it is intended. Various modifications may be made to the details described, and all parts and groups may be substituted by their technically equivalent means.

I claim:

1. A railway train set intended to be used for the renewal of railroads by replacing old sleepers by new sleepers and levelling or displacing or scarifying the ballast, comprising a first vehicle having two axles or bogies, a second vehicle having a single axle or bogie, said first and second vehicles forming an operative assembly, said second vehicle being articulated at one of its own ends to a point of said first vehicle, situated in a position cantilevered with respect to the two axles thereof, said single axle or bogie of the second vehicle being situated at the end opposite that articulated to the first vehicle; said first vehicle having means, situated between said two axles thereof, for removing the old rails, means for allowing the second axle thereof to advance on the old sleepers already deprived of the rails, and means for handling the old rails and the old and the new sleepers; said second vehicle having means for removing the old sleepers, means for levelling or displacing or scarifying the ballast, and means for laying the new sleepers, as well as means for allowing said second vehicle to advance on the new sleepers not yet provided with the new rails; and said two vehicles having, in the region in which said second vehicle is articulated to said first vehicle, means for correcting, according to the necessities, the position of the second vehicle relative to the first vehicle and hence the position of the means for laying the new sleepers, said means for correcting the position of the second vehicle relative to the first vehicle comprising a pair of horizontal hydraulic cylinders installed between the two vehicles on both sides thereof, and said means for correcting the position of the second vehicle relative to the first vehicle further comprising, at each side of the train set, a vertical hydraulic cylinder which determines the elevation of the corresponding side of the second vehicle relative to the first vehicle.

2. A railway renewal train set as claimed in claim 1, wherein said means for correcting the position of the second vehicle relative to the first vehicle further comprise potentiometers, for detecting the angle formed between the two vehicles.

3. A railway renewal train set as claimed in claim 1, wherein said means for laying the new sleepers comprisite a chute for the d escent of the new sleepers, a terminal trap of said chute, means for lowering and lifting said trap, a grasping device pivoted facing said trap and arranged to grasp the first sleeper present on the chute and to dispose the same onto the underlaying ballast, and means for actuating said grasping means in a manner coordinated with the displacements of said trap.

4. A railway renewal train set as claimed in claim 1, wherein said second vehicle comprises a special store for sleepers and a laying device, for the laying of special sleepers in particular regions of the railroad.

* * * * *